United States Patent [19]

Shrock

[11] 3,950,015

[45] Apr. 13, 1976

[54] NEGOTIABLE INSTRUMENT

[76] Inventor: Cecil C. Shrock, 5016 N. Winthrop Ave., Chicago, Ill. 60640

[22] Filed: Oct. 10, 1973

[21] Appl. No.: 404,872

Related U.S. Application Data

[63] Continuation of Ser. No. 270,597, July 11, 1972, abandoned.

[52] U.S. Cl. ..... 283/7; 283/8 R; 283/57

[51] Int. Cl.[2] ..... B42D 15/00

[58] Field of Search ..... 283/6–9, 57, 283/58, 59; 282/22, 23

[56] References Cited

UNITED STATES PATENTS

| | | | |
|---|---|---|---|
| 1,565,255 | 12/1925 | Byquist | 283/58 X |
| 1,833,433 | 11/1931 | Opitz | 283/58 |
| 2,163,777 | 6/1939 | Deutsch | 283/7 X |
| 3,283,713 | 11/1966 | Wooster | 283/7 X |

*Primary Examiner*—Lawrence Charles
*Attorney, Agent, or Firm*—Edward J. Brenner

[57] ABSTRACT

A negotiable instrument similar to a conventional travelers cheque but distinguishable in several important details; i.e., the cashing party has positive identification that the person cashing a cheque is the proper payee. Since the cashing agency has this assurance, the holder of the cheque is able to obtain cash even in areas far remote from home.

5 Claims, 3 Drawing Figures

NEGOTIABLE INSTRUMENT

This is a continuation of application Ser. No. 270,597 filed July 11, 1972, now abandoned.

SUMMARY OF THE INVENTION

Heretofore, travelers cheques have been known which bore a single signature placed thereon at the time of purchase and a counter-signature in the presence of the cashing party was necessary to turn the instrument into cash. Applicant has found that this system has a distinct disadvantage in that travelers cheques in their present form have not been accepted in some areas of the country despite the above precaution. Presumably, the reason for refusing to cash travelers cheques as presently known is that an unauthorized person in possession of the travelers cheques could merely practice the signature that already appears on the cheques and thereby deceive the cashing agency. Furthermore, a distinct disadvantage of conventional travelers cheques is that they must be purchased by the payee before embarking on a trip. There is no positive way, not excluding cashiers checks, of assuring a constant supply of cash at various parts of the country to one whose calling requires extensive travel.

The present invention contemplates a travelers cheque which may be carried in blank by the traveler with no signature appearing thereon, which may be signed in the presence of the cashing agent and in which the cashing party may identify himself by an identification certificate which is non-negotiable, includes his signature, the serial number of his account (which also appears on each of the travelers cheques), the printed name of payee and a photograph of the payee. The invention also contemplates that each cheque bear a photographic resemblance of the payee for ready comparison of the photograph on the identification instrument. By this arrangement, a traveler can write cheques regardless of where he may be without the need for purchasing cheques at the beginning of a trip for the entire trip. In addition, travelers cheques made in accordance with the invention may be safely sent through the mails to the traveler wherever he may be and when used with the identification certificate made in accordance with the invention, the result is similar to a money order.

DESCRIPTION OF THE PREFERRED EMBODIMENTS

Figure 1:
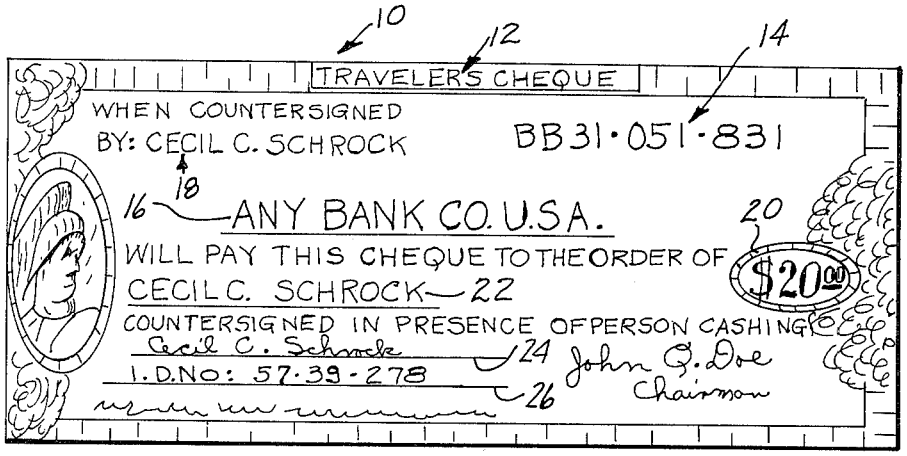
FIG. 1 is a plan view of a travelers cheque of Twenty Dollar ($20.00) denomination made in accordance with the present invention.

Referring now to the drawing and more particularly to FIG. 1, the travelers cheque of the invention is referred to by reference numeral 10 and includes a flat sheet of high-grade document type paper having the legend "travelers cheque" at the top thereof as indicated by reference numeral 12 and having a serial number 14. The reference numeral 16 indicates the drawee bank or guarantor while reference numeral 18 indicates the name of the drawer printed on the cheque.

Reference numeral 20 is the printed amount of the cheque and reference numeral 22 indicates again the printed name of the drawer. Line 24 is for the signature of the drawer when presented in conjunction with the identification certificate of FIG. 3 as will be hereafter apparent. Line 26 is the identification number of the drawer which is filled in from the identification certificate by the drawer at the time of cashing the cheque.

Figure 2:
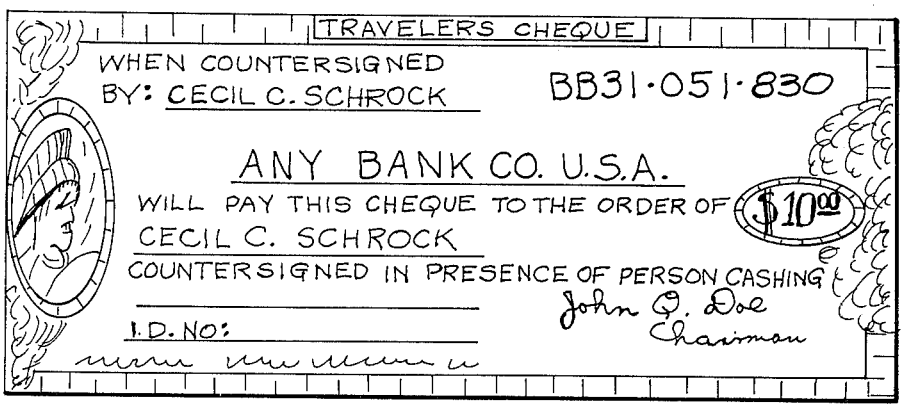
FIG. 2 is a plan view similar to FIG. 1 but illustrating a travelers cheque of Ten Dollar ($10.00) denomination.

FIG. 2 is a travelers cheque similar to FIG. 1 but depicting a cheque of Ten Dollar ($10.00) denomination. It will be noted that the travelers cheque of FIG. 2 is unsigned and could not be cashed by anyone except the drawer when the certificate of FIG. 3 is presented.

Figure 3:
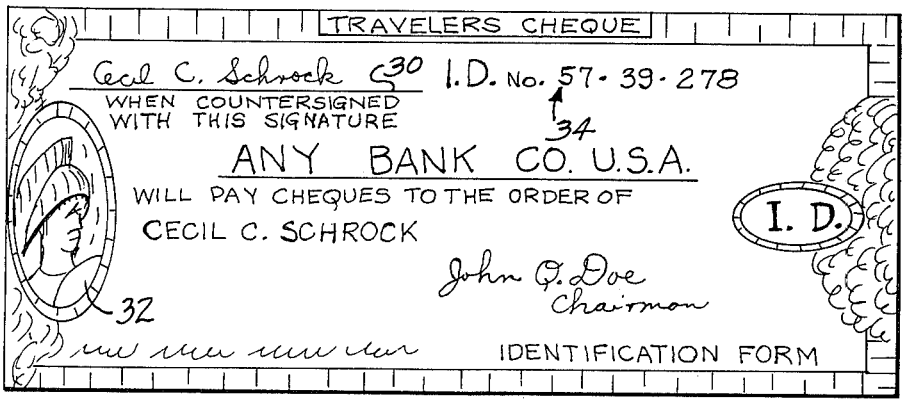
FIG. 3 is a plan view of an identification certificate used in cashing the cheques of FIGS. 1 and 2.

FIG. 3 is the identification certificate which is similar in shape and form to the travelers cheque itself and bears a line 30 for the permanent signature of the drawer. At 32 is indicated a space for the photograph of the drawer. At 34 is indicated the identification number of the drawer which is exclusive with him.

The travelers cheque of the present invention exhibits important advantages over travelers cheques heretofore known. For instance, the certificate of FIG. 3 could be carried in the wallet of the user while the travelers cheques of FIGS. 1 and 2 could be carried in a separate pocket as recommended by the principal travelers cheques' companies. FIG. 2 indicates the travelers cheque as carried by the user. It clearly indicates that it is payable only when countersigned in the presence of the person cashing the cheque when the certificate of FIG. 3 is presented.

FIG. 1 indicates the cheque as it appears when ready for cashing. It will be noted that it includes the signature and the identification number of the user. The certificate of FIG. 3 bears the photograph of the user thus providing another positive form of identification. As the cheque is signed, the cashing person can examine the signature as shown permanently on the identification certificate of FIG. 3. It will be apparent that the travelers cheque of the present invention has a distinct advantage over conventional travelers cheques in that, if lost, it cannot be cashed by an unauthorized person who has the signature of the drawer available directly on the travelers cheque. Obviously, it would be necessary for the person finding such travelers cheques to also find the user's wallet. In any event, whether a travelers cheque made in accordance with the present invention ever passes into the hands of an unauthorized person, it cannot be cashed since he would also have to have an identification certificate as shown in FIG. 3 with a photograph of the authorized user. Travelers cheques in accordance with the invention may be purchased from time to time by a travelers' home office from the drawee bank which becomes the payer or guarantor and sent to the traveler in the form illustrated in FIG. 2. In this form, they would not be cashable by anyone else. In this sense, the travelers cheque in the invention functions like a money order.

It will be appreciated that the issuing agency also issues the identification certificate. The identification number used may be a social security number.

What I claim is:

1. A system for transmitting funds comprising a plurality of blank travelers cheques each bearing the printed name of the intended recipient, the amount payable, a serial number and a single space for the recipient to sign his name and his identification number, said cheques being issued in blank with respect to the recipient's signature, an identification certificate bearing the user's printed name, his signature, and an exclusive identification number, whereby each cheque may be authenticated at the time of cashing by signing and filling in the identification number in the presence of the person cashing who has been presented with the identification certificate, said cheques being issued separate from and subsequent to the issuance of said identification certificate, whereby said identification certificate may be used repeatedly for the cashing of a plurality of cheques from time to time.

2. A system in accordance with claim 1 wherein each cheque represents committed funds but is cashable only by the person named who can sign said cheque in the presence of the cashing person who has the casher's identification certificate in view.

3. A system in accordance with claim 1 wherein the unsigned check may be purchased by other than the casher and safely sent by mail.

4. A system in accordance with claim 1 wherein the identification certificate bears the photograph of the casher.

5. A system in accordance with claim 1 wherein each cheque bears the social security number of the user.

* * * * *